United States Patent [19]

Woods et al.

[11] Patent Number: 4,562,799

[45] Date of Patent: Jan. 7, 1986

[54] MONOLITHIC CERAMIC CYLINDER LINER AND METHOD OF MAKING SAME

[75] Inventors: Melvin E. Woods; Chi Cheng; Roy Kamo, all of Columbus, Ind.

[73] Assignee: Cummins Engine Company, Inc., Columbus, Ind.

[21] Appl. No.: 458,557

[22] Filed: Jan. 17, 1983

[51] Int. Cl.[4] ..... F02F 1/04

[52] U.S. Cl. ..... 123/193 C; 123/668; 123/41.67

[58] Field of Search ..... 123/193 R, 193 C, 668, 123/669, 41.67

[56] References Cited

U.S. PATENT DOCUMENTS

| | | | |
|---|---|---|---|
| 3,099,983 | 8/1963 | Orlando et al. | 123/41.67 |
| 4,244,330 | 1/1981 | Baugh et al. | 123/913 C |
| 4,419,971 | 12/1983 | Nakamura et al. | 123/193 C |

FOREIGN PATENT DOCUMENTS

| | | | |
|---|---|---|---|
| 0033911 | 3/1979 | Japan | 123/193 C |

*Primary Examiner*—Craig R. Feinberg

*Attorney, Agent, or Firm*—Sixbey, Friedman & Leedom

[57] ABSTRACT

A replaceable monolithic, hollow, generally cylindrical cylinder liner formed of hot pressed silicon nitride adapted for operating at the high engine temperatures caused by fuel combustion and friction within the liner without need for liquid cooling thereof. The liner includes a surface adjacent its outer end for forming a radial press fit with the inside surface of the cylinder cavity and a stop-engaging surface formed on the cylindrical liner surface spaced axially inwardly of the press fit surface or along the innermost face of the liner for engaging an engine block liner stop within the cylinder cavity.

10 Claims, 2 Drawing Figures

MONOLITHIC CERAMIC CYLINDER LINER AND METHOD OF MAKING SAME

DESCRIPTION

1. Technical Field

The present invention relates generally to cylinder liners for internal combustion engines and, more particularly, to monolithic cylinder liners formed of hot pressed silicon nitride.

2. Background Art

The incorporation of replaceable cylinder liners in the design of internal combustion engines provides numerous advantages to the manufacturer and user of such engines. For example, cylinder liners eliminate the necessity to scrap an entire engine block during manufacturing should the inside surface of one cylinder be improperly machined. In addition, when excessive wear occurs through use, cylinder liners are replacable during engine overhaul allowing the reuse or use of standard size pistons and rings rather than oversize pistons and rings which would be necessary if the cylinder had to be rebored. Despite these and other advantages, numerous problems attend the use of replaceable cylinder liners as exemplified by the great variety of liner designs in use by engine manufacturers.

Cylinder liners for internal combustion engines must exhibit a variety of desirable characteristics in order to satisfy the needs of modern day engines. For example, cylinder liners must exhibit outstanding wear characteristics, have high strength properties, be capable of withstanding thermal shock and corrosive environments and, most importantly, must be able to retain these desirable characteristics at the high temperatures commonly encountered in internal combustion engine operations. Typically, such cylinder liners are formed of metals, such as cast iron. However, despite their many desirable characteristics, metal liners are poor insulators and exhibit significantly reduced flexual, creep and other strength characteristics at elevated temperatures. In order to maintain the metal cylinder liner temperature within acceptable limits it is typically necessary to surround the liner with a heat exchange fluid passage or jacket for passing heat removing liquid coolant, ordinarily water, therethrough. However, in the use of liquid cooling to solve the metal temperature/strength problem a number of other problems are created, not the least of which is the problem of configuring the liner and cylinder cavity for effectively sealing the coolant within the passage or jacket.

Typically, metal liners are fabricated in the form of a generally cylindrical sleeve, the inner cylindrical surface of which defines a fuel combustion zone in which a piston reciprocates between upper and lower limits and the outer cylindrical surface of which has at least a portion thereof forming a wall of the liquid coolant passage or jacket in direct contact with the liquid coolant. The wall thickness of this so-called wet-type liner, in order to transfer combustion and friction generated heat by conduction through the liner wall to the liquid coolant, must be relatively thin. Unfortunately, thin walled, metal liners readily deform under the axial compressive load generally imposed by the engine head, creating coolant and lubricant sealing problems and exacerbating the piston scuffing problem.

One very common liner design, known as a top stop liner, generally involves provision of a cylindrical liner body with a radially outwardly extending flange located at the upper end of the liner for being seated in a counterbored recess of the cylinder cavity so that the liner may be clamped into place by the engine head. Typically, the liner is liquid cooled and, in order to provide for coolant flow, a seal is normally formed between the engine block and a portion of the liner spaced below the upper end flange to form an axially extending coolant jacket around the liner between the upper end flange and the seal. However, due to vibration and thermally induced size changes in the liner, relative motion occurs in the seal area which tends to destroy the coolant seal. It has been suggested that cylinder liner designs which position the radial block engaging flange below the upper end of the liner may, to some extent, deal with thermally induced size changes and the sealing problems attendant thereto. It has also been suggested that various complicated composite liner structures be employed to eliminate differential thermal growth between the liner and block or to compensate for its existence. Other proposals involve using relatively complicated seal configurations. However, notwithstanding the advantages of each of the many suggestions and proposals for dealing with the liquid coolant sealing problems in replaceable cylinder liners, there are significant problems which attend the use of each and, to date, no optimum liner design has been found. In particular, no known liner allows for the inexpensive manufacture of a low friction, low wear rate liner which avoids the sealing difficulties previously encountered. Accordingly, it is a purpose of the present invention to provide a replaceable cylinder liner which requires no cooling liquid and, therefore, avoids coolant sealing problems, which is a good insulator, particularly as compared to metals, which exhibits low friction and wear rates and which is configured and formed in a manner and of a material to ensure a long service life.

DISCLOSURE OF THE INVENTION

In one aspect of the present invention this is accomplished by providing a liner for a cylinder cavity within the block of an internal combustion engine, the liner adapted for operating at the high temperatures caused by fuel combustion and friction therewithin without liquid cooling thereof, comprising a monolithic, hollow, generally cylindrical body formed from hot pressed silicon nitride.

In another aspect of the present invention the cylinder liner includes press fit means on the outer cylindrical surface adjacent the outer end portion of the cylindrical body for providing a press fit of the outer end portion within the cylinder cavity and a downwardly facing surface spaced axially below the press fit means for seating on and being supported by an upwardly facing engine block liner stop positioned within the cylinder cavity, the outer cylindrical surface of the hollow cylindrical body between the press fit means and the downwardly facing surface forming one wall of an air space between the liner and the block.

In still another aspect of the present invention, the cylinder liner comprises at least two preformed generally cylindrical, annular sections coaxially interconnected in end-to-end relationship to form the monolithic, hollow cylindrical body, the diameter of the inner cylindrical surfaces of each section being the same.

BRIEF DESCRIPTION OF THE DRAWINGS

The invention will be better understood from the following description taken in conjunction with the accompanying drawings in which.

BEST MODE FOR CARRYING OUT THE INVENTION

The present invention is directed to a replaceable cylinder liner of unusually simple design capable of improved performance compared with presently known liners and allowing desirable modifications in the cooling system of internal combustion engines. In particular, the cylinder liner of the present invention eliminates the need for liquid cooling thereof and permits a significant reduction in the total flow and heat dissipating capacity of the engine liquid cooling system. This advantage is achieved by a cylinder liner which is formed of hot pressed silicon nitride (HPSN).

Figure 1:
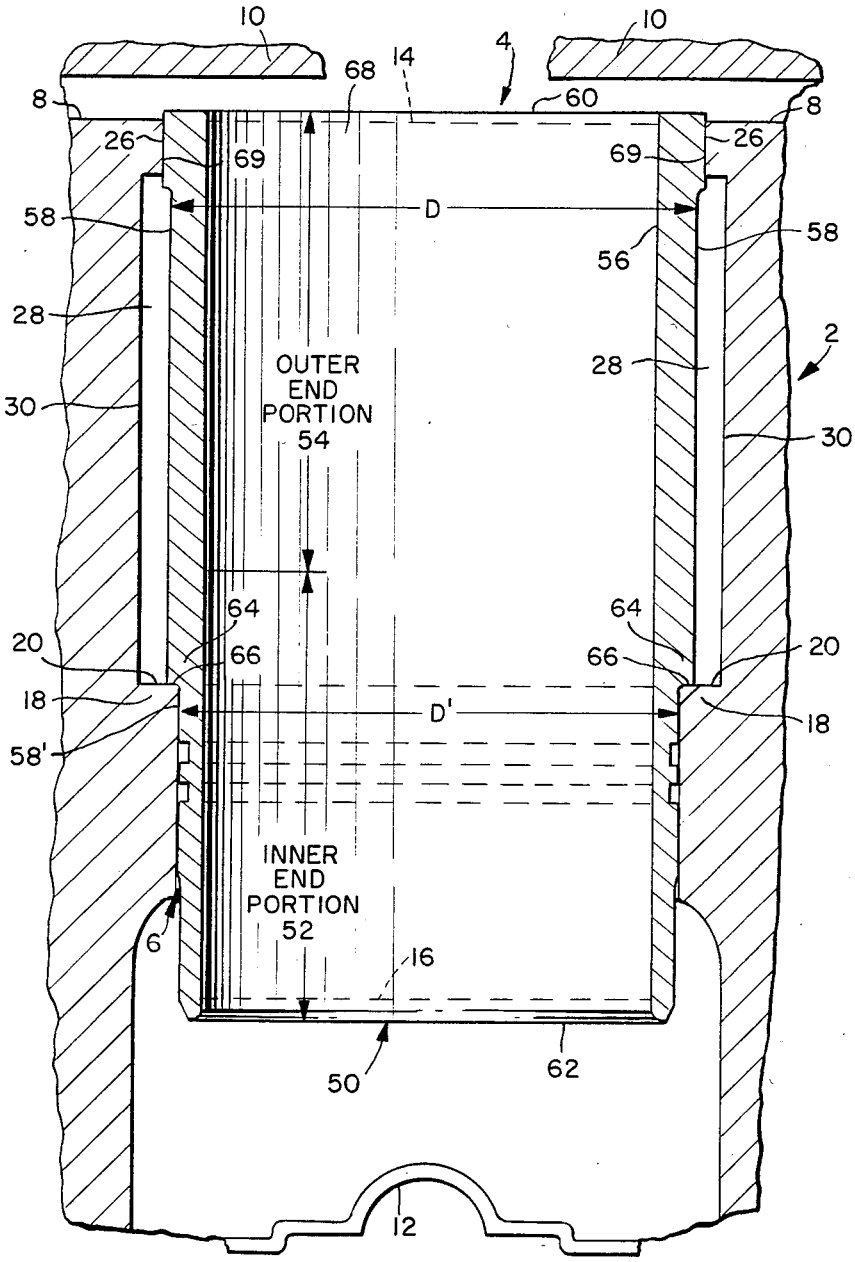
FIG. 1 is a broken away cross-sectional view of a replaceable mid-stop cylinder liner and engine block designed in accordance with the present invention.
Figure 2:
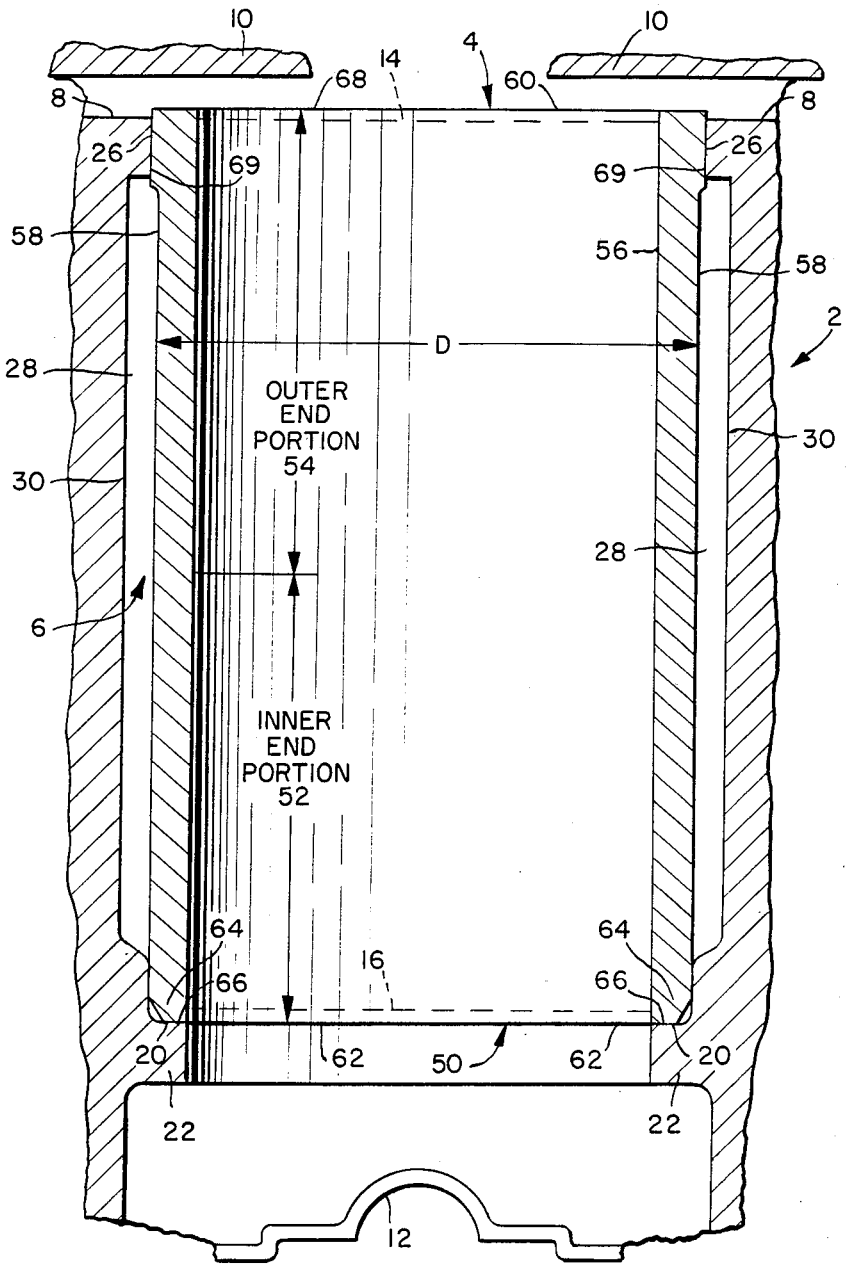
FIG. 2 is a broken away, cross-sectional view of a replaceable bottom stop cylinder liner and engine block designed in accordance with the present invention.

To better understand the present invention, reference is made to FIGS. 1 and 2 in which portions of an engine block 2 are illustrated in combination with a cylinder liner 4 constructed in accordance with the present invention. Engine block 2 includes a cylinder cavity 6 extending between a surface 8 for engaging the engine head 10 and a crank shaft receiving area 12. A piston, not shown, is connected to the engine crank shaft, not shown, by a connecting rod, not shown, to cause the piston to travel reciprocally within the liner between upper limit 14 (reached by the piston top) and lower limit 16 (reached by the piston bottom). The engine block 2 is further provided with a liner stop 18 in the form of an upwardly facing surface or shoulder 20. A mating stop engagement surface 64, in the form of a downwardly facing surface or shoulder 66, is formed on the exterior of the cylinder liner 4. Liner stop 18 and mating stop engagement surface 64 are axially positioned, respectively, on engine block 2 and liner 4 to cause the outer end 68 of the cylinder liner to protrude slightly beyond the surface 8 of engine block 2. In this way, the cylinder liner 4 is held under an axially compressive load between head 10 at its outermost end 68 and liner stop 18 engaging mating stop engagement surface 64. For purposes of this description, the term "outer" will refer to a direction away from the crank shaft of the engine whereas the term "inner" will refer to a direction toward the engine crank shaft.

The outer end 68 of the cylinder liner 4 is radially postioned within cylinder cavity 6 by means of a radial press fit between a press fit surface 69 on the outer end 68 of the liner 4 and a mating, inwardly projecting cylindrical surface 26 formed on the interior of the cylinder cavity 6 adjacent the engine head engaging surface 8. Between cylindrical surface 26 and stop 18 of engine block 2, an air gap 28 is formed for providing an insulating barrier to the loss of heat generated within the cylinder liner 4 due to friction and fuel combustion. An annular recess 30 is formed in the wall of cylinder cavity 6 between the inner end of cylindrical surface 26 and stop 18 to form the outer wall of air gap 28 with the corresponding portion of the outer cylindrical surface 58 of cylinder liner 4 providing the inner wall of the air gap. It can be seen that the axial length of air gap 28 is determined by the positioning of stop 18 within cavity 6 and mating stop engagement surface 64 on liner 4. Desirably, stop 18 and stop engagement surface 64 are positioned along the inner half of liner 4 such that the air gap 28 extends over more than 50% of the total axial length of the liner. In one embodiment, shown in FIG. 2, liner stop 18 is formed by a radially inwardly directed flange 22 having an upwardly facing surface or shoulder 20 which is positioned to engage the downwardly facing surface of mating stop engagement surface 64, in this case corresponding to the innermost face 62 of cylinder liner 4.

The liner 4 of the present invention includes a hollow cylindrical body 50 having an inner end portion 52 and an outer end portion 54. A cylindrical piston engaging inside surface 56 extends the entire axial length of the hollow cylindrical body 50. Outside cylindrical surface 58 is of substantially uniform outside diameter D along its length extending inwardly from outermost face 60 to the intersection with outside cylindrical surface 58' of reduced diameter D'. At the intersection there is formed a stop engaging surface 64, in the form of downwardly facing shoulder 66, for engaging the upwardly facing shoulder 20 of liner stop 18 in cylinder cavity 6. Alternatively, stop engaging surface 64 and shoulder 66 may be formed on liner 4 by a circumferential stop boss or flange (not shown) extending outwardly from the outside cylindrical surface and including a downwardly facing stop engaging surface for engaging liner stop 18. Desirably, stop engaging surface 64 is positioned along inner end portion 52, as illustrated in FIG. 1, or comprising innermost face 62 as illustrated in FIG. 2.

The outer end 68 of outer end portion 54 of the liner frictionally engages inwardly projecting cylindrical surface 26 for closing the outer end of air gap 28 and for resisting the deforming forces resulting from fuel combustion within the hollow cylindrical body. In particular, extremely high combustion pressures tend to occur adjacent the upper limit of piston travel since the greatest compression of the fuel/air charge occurs at this point as does ignition of the charge, which adds further to the gas pressures. To avoid the necessity of providing an extremely thick outer rim on the liner, it is necessary to rely upon the engine block to provide resistance to radial expansion of the cylinder liner adjacent its outermost end. It is also desirable to avoid radial movement of the outer end of the liner to avoid radial movement between the liner and the head gasket rim which seals the upper end of the piston cylinder. In addition, it is essential that the liner be very accurately positioned within the cylinder cavity at at least one point along the axial length of the liner. These results are achieved by making the diameter of the cylinder cavity 6 at cylindrical surface 26 slightly smaller than the corresponding liner diameter at outer end 68 to cause the liner to be press fitted within the cavity and to force the liner into a precisely desired position.

In accordance with the present invention cylinder liner 4 is fabricated of hot pressed silicon nitride. Silicon nitride is a ceramic material known to possess in the hot pressed form, good mechanical and strength properties at elevated temperatures and to exhibit excellent thermal shock, creep and oxidation resistance. Due to these properties it has been suggested for use in the manufacture of components, such as discs, vanes and blades, of gas turbine engines. See, U.S. Pat. Nos, 3,972,662 and 3,973,875. British Pat. No. 1,338,712 teaches that silicon nitride components are heat insulating and discloses its use, albeit not in the hot pressed form, as a thermal blanket for surrounding a chrome cast iron cylinder liner and for forming silicon nitride piston portions. U.S. Pat. No. 4,113,830 teaches a method for fabricating high density, high strength hot pressed silicon nitride bodies and suggests that the method can be advantageously employed in fabricating parts such as turbine stators, turbine vanes, rocket nozzle liners, automotive engine liners and radomes. However, notwithstanding these general suggestions for silicon nitride use, in fact there are no practical teachings available as to how the desirable characteristics of silicon nitride can be advantageously applied, particularly when the difficulty in actually fabricating shaped silicon nitride bodies is appreciated.

Industrial Applicability

In accordance with the present invention, the use of hot pressed silicon nitride in the fabrication of mid-stop and/or bottom stop replaceable engine cylinder liners provides a liner which can operate at the high temperatures experienced in internal combustion engines without need for liquid cooling of the liner. This is because hot pressed silicon nitride, unlike conventional engine liner metals such as cast iron, retains its outstanding tensile, compression, flexual and creep strength at elevated temperatures which far exceed those normally experienced in internal combustion engines. At the same time, hot pressed silicon nitride exhibits an excellent wear rate and a low coefficient of friction compared to metals. For example, the coefficient of friction of steel on hot pressed silicon nitride is only 0.03–0.5 as compared with the coefficient of friction for steel on steel of about 0.11. In addition, hot pressed silicon nitride is a good insulator compared to metals. As a result, the heat generated within the liner by combustion and friction is retained by the insulating liner within the combustion gases. This retention is aided by the imposition of an air gap between the liner and the block to further insulate the liner, rather than a liquid coolant containing jacket, as is conventional, to cool the liner for removing heat therefrom. The heat generated within the liner by combustion and friction is substantially retained within the liner by virtue of the insulating properties of the hot pressed silicon nitride and air gap 28 to increase substantially the temperature of the exhaust gases and to permit more efficient and increased energy recovery therefrom in a turbocharger unit. Moreover, the fabrication of hot pressed silicon nitride into a monolithic mid-stop and/or bottom stop liner results in less oval deflection when the head places the liner in axial compression. As a consequence lubricant consumption is reduced and piston scuffing is minimized.

The monolithic liner of the present invention is advantageously fabricated from silicon nitride ceramic exhibiting high strength, such as high modulus of rupture (bending strength) at elevated temperatures, high resistance to creep and thermal shock, low porosity and high resistance to oxidation. Suitable silicon nitride ceramic materials may be formed by use of any of the many well known techniques for hot pressing and pressure sintering and the monolithic liner of the present invention may be formed therefrom by a unique fabrication method which is more fully described hereinafter. Thus, hot pressed silicon nitride may be formed generally by processes in which high purity silicon nitride powder is admixed with a quantity of fluxing agent or sintering aid ranging from about 0.1 to 25% by weight, depending upon the fluxing agent or sintering aid employed. Exemplary agents and aids include such materials as powdered magnesium oxide, magnesium nitride, beryllium oxide, beryllium nitride, calcium oxide, calcium nitride, aluminum oxide, ferric oxide; sources of yttrium, such as yttrium oxide, chloride and nitride; and the oxides, hydrides and nitrides of the lanthanide series elements. The powered mixture is transferred to a conventional graphite hot pressing die and subjected to pressures in the range 3000 to 7000 psi and temperatures in the range 1500° to 1900° C. for from ½ to several hours, after which the assembly is allowed to cool to room temperature. The silicon nitride billet produced by this general procedure has a very high density, i.e., a porosity of 0.2% or less, a bulk density approaching the theocritical density of 3.2 gm/cc and very high strength levels, for example a modulus of rupture of about 50,000 to 120,000 psi at 20° C. and from 20,000 to 60,000 psi at 1200° C. The high purity silicon nitride powder starting material may be commercially purchased or prepared by such techniques as nitriding very high purity (at least 98% pure) finely divided silicon metal powder at temperatures in the range 1300° to 1650° C.; reacting a silicon chloride powder with ammonia or mixtures of hydrogen and nitrogen at 1300° to 1650° C.; or reacting a silicon chloride powder with ammonia at −70° C. to 1300° C. and pyrolyzing the reaction product. The specifics of the various techniques for preparing high purity silicon nitride powders and for forming hot pressed silicon nitride ceramic bodies are well known to the art and reference is had for illustrative methods to U.S. Pat. Nos. 3,830,652 and 4,113,830 and to British Pat. No. 970,639.

The monolithic, hot pressed silicon nitride cylinder liner of the present invention is advantageously fabricated by coaxially interconnecting in end-to-end relationship two or more hot pressed silicon nitride cylindrical blanks, i.e., annular sections, having the same diameter inner cylindrical surfaces. More specifically, any of the well known hot pressing techniques may be used to hot press silicon nitride powder in a graphite die configured to produce cylindrical billets having the desired inner diameter of the desired cylinder liner. For example, for a cylinder liner having an overall height between its innermost and outermost faces of from 11 to 12 inches, it has been found useful to hot press silicon nitride powder into three cylindrical sections of about 3.5 to 4 inches height and having a 5.3" ID and 6.7" OD. The end faces of each cylindrical section are machined flat for improved end-to-end contact when the sections are assembled. Silicon nitride powder is applied between the end faces of adjacent cylindrical sections and the coaxially, end-to-end assembled cylindrical sections are subjected to high temperatures, in the range 1500° to 1900° C. , and high pressures, in the range 3000 to 7000 psi, to hot press and bond the cylindrical sections into a monolithic cylindrical blank having the desired inner diameter for the cylinder liner. The hot pressed silicon nitride cylindrical blank is thereafter machined, as needed, into a cylinder liner having the desired configuration.

We claim:

1. An internal combustion engine assembly for an engine cooled by the circulation of a liquid engine coolant, said assembly comprising (a) an engine block containing at least one cylinder cavity completely isolated from said liquid engie coolant circulation having a liner stop positioned within said cylinder cavity at a substantial distance from the outer end of said cavity and having a predetermined diameter over a substantial portion of the longitudinal distance from the liner stop to said outer end of said cavity; and (b) a monolithic hollow cylindrical body formed of hot pressed silicon nitride having an inner end portion and an outer end portion, said body including (1) press fit means on the outer surface of said hollow cylindrical body adjacent the outer end of said outer end portion for preventing radial movement of said outer end portion by forming a radial press fit with the inside surface of said cylinder cavity by compressively and frictionally engaging the inside surface of said cylinder cavity when pressed thereinto; and (2) a stop means formed on said hollow cylindrical body spaced axially inwardly of said press fit means for positioning said body within the cylinder cavity, said stop means including a stop engaging surface for engaging the engine block liner stop, said hollow cylindrical body between said press fit means and said stop means having an outer diameter which is less than said predetermined diameter to form a clear, unobstructed annular air space surrounding said hollow cylindrical body between said body and the adjacent cylinder cavity wall.

2. A liner, as claimed in claim 1, wherein said body comprises at least two preformed generally cylindrical, annular sections coaxially interconnected in end-to-end relationship to form said monolithic body, the inner cylindrical surfaces of the sections having equal diameters.

3. A liner, as claimed in claim 1, wherein said stop means comprises the innermost end face of said hollow cylindrical body.

4. A liner, as claimed in claim 1, wherein said stop engaging surface is positioned to cause said outer end portion of said hollow cylindrical body to extend a predetermined distance beyond the outer extreme of the cylinder cavity when said stop engaging surface is placed in contact with the engine block liner stop.

5. A liner, as claimed in claim 1, wherein said annular air space extends over more than 50 percent of the total axial length of said liner.

6. A liner as claimed in claim 1, in which said annular air space is located above said stop means.

7. A liner as claimed in claim 1, wherein said annular air space is symmetrical.

8. A liner, as claimed in claim 1, wherein said stop means is formed on the outer surface of said hollow cylindrical body intermediate said press fit means and the inner end of said inner end portion.

9. A liner, as claimed in claim 8, wherein said stop engaging surface comprises an inwardly facing surface for engaging an outwardly facing surface on said engine block liner stop.

10. A liner, as claimed in claim 8, wherein said stop means is positioned on the outer surface of said hollow cylindrical body along the inner half of said cylindrical body axial length.

* * * * *